US012778313B2

(12) United States Patent
Hu

(10) Patent No.: US 12,778,313 B2
(45) Date of Patent: Nov. 3, 2026

(54) FRAME FOLDING MECHANISM AND CRIB FRAME

(71) Applicant: Wonderland Switzerland AG, Steinhausen (CH)

(72) Inventor: Junjie Hu, Steinhausen (CH)

(73) Assignee: Wonderland Switzerland AG, Steinhausen (CH)

( * ) Notice: Subject to any disclaimer, the term of this patent is extended or adjusted under 35 U.S.C. 154(b) by 86 days.

(21) Appl. No.: 18/567,142

(22) PCT Filed: Jun. 10, 2022

(86) PCT No.: PCT/EP2022/065819
§ 371 (c)(1),
(2) Date: Dec. 5, 2023

(87) PCT Pub. No.: WO2022/258803
PCT Pub. Date: Dec. 15, 2022

(65) Prior Publication Data

US 2024/0268569 A1 Aug. 15, 2024

(30) Foreign Application Priority Data

Jun. 10, 2021 (CN) ..... 202110648821.6

(51) Int. Cl.
*A47D 9/00* (2006.01)

(52) U.S. Cl.
CPC ..... *A47D 9/005* (2013.01)

(58) Field of Classification Search
CPC . A47D 7/00; A47D 9/00; A47D 9/005; A47D 9/008; A47D 9/012
(Continued)

(56) References Cited

U.S. PATENT DOCUMENTS 8,490,554 B2 7/2013 Jin
9,072,645 B2 * 7/2015 Gamman ..... A61G 7/012
(Continued)

FOREIGN PATENT DOCUMENTS

CN 2922647 Y 7/2007
CN 201230749 Y 5/2009
(Continued)

OTHER PUBLICATIONS

"Second Office Action Issued in Corresponding Chinese Patent Application No. 202110648821.6", Mailed Date: Jun. 27, 2025, 15 pages.

(Continued)

*Primary Examiner* — David E Sosnowski
(74) *Attorney, Agent, or Firm* — Volpe Koenig

(57) ABSTRACT

The present application discloses a frame folding mechanism of a crib frame, which is used for a crib frame. The crib frame includes a frame portion and a supporting portion. The frame folding mechanism includes a transverse rod positioned below the frame portion; a connecting rod having a first end pivotably connected to the supporting portion; and a clamping assembly sleeved on the transverse rod. A second end of the connecting rod opposite to the first end may be pivotably connected to the clamping assembly, and the clamping assembly may be manipulated to fix the clamping assembly with the transverse rod or slide the clamping assembly relative to the transverse rod. The frame folding mechanism of the crib frame has a stable structure and is not easy to shake when in use.

20 Claims, 8 Drawing Sheets

(58) Field of Classification Search
USPC ..... 5/99.1
See application file for complete search history.

(56) References Cited

U.S. PATENT DOCUMENTS

| | | | | |
|---|---|---|---|---|
| 11,957,254 | B2 * | 4/2024 | Chui | A47D 9/012 |
| 2004/0133977 | A1 | 7/2004 | Vidal | |
| 2011/0113549 | A1 * | 5/2011 | Riddiford | A47D 9/005 5/98.1 |
| 2015/0000034 | A1 * | 1/2015 | Geng | A47D 9/012 5/11 |
| 2018/0206651 | A1 | 7/2018 | Gallina | |
| 2020/0170415 | A1 * | 6/2020 | Broussard | A47C 17/165 |
| 2021/0076841 | A1 * | 3/2021 | Hu | A47D 9/012 |
| 2021/0076842 | A1 * | 3/2021 | Guo | A47D 9/02 |

FOREIGN PATENT DOCUMENTS

| | | | | | |
|---|---|---|---|---|---|
| CN | 103202634 | A | | 7/2013 | |
| CN | 203391844 | U | | 1/2014 | |
| CN | 103863380 | A | | 6/2014 | |
| CN | 204950243 | U | * | 1/2016 | |
| CN | 205696849 | U | | 11/2016 | |
| CN | 108113338 | A | | 6/2018 | |
| CN | 108143176 | A | | 6/2018 | |
| CN | 208144825 | U | | 11/2018 | |
| CN | 109393840 | A | | 3/2019 | |
| CN | 208973105 | U | | 6/2019 | |
| CN | 209003360 | U | | 6/2019 | |
| CN | 209090540 | U | * | 7/2019 | |
| CN | 209202553 | U | | 8/2019 | |
| CN | 110338595 | A | * | 10/2019 | A47D 9/005 |
| CN | 110367746 | A | * | 10/2019 | A47D 9/005 |
| CN | 112515408 | A | | 3/2021 | |
| CN | 112741453 | A | * | 5/2021 | A47D 7/01 |
| CN | 214386918 | U | * | 10/2021 | A47D 9/005 |
| CN | 114794794 | A | * | 7/2022 | A47D 9/012 |
| CN | 115316816 | A | * | 11/2022 | A47D 9/005 |
| CN | 108113338 | B | * | 10/2024 | A47D 9/012 |
| JP | 60032919 | U | | 3/1985 | |
| KR | 20200016665 | A | | 2/2020 | |
| KR | 1020230113296 | A | | 7/2023 | |
| KR | 20250054094 | A | * | 4/2025 | A47D 9/016 |
| TW | M305625 | U | | 2/2007 | |
| TW | 201331482 | A1 | | 8/2013 | |
| WO | 2009144474 | A1 | | 12/2009 | |

OTHER PUBLICATIONS

"First Office Action Issued in Corresponding Chinese Patent Application No. 202110648821.6", Mailed Date: Nov. 13, 2024, 7 pages.
"Office Action Issued in Corresponding Japanese Patent Application No. 2023-574670", Mailed Date: Sep. 24, 2024, 4 pages.
"Office Action Issued in Corresponding Taiwanese Patent Application No. 112140174", Mailed Date: Mar. 14, 2024, 7 pages.
International Search Report and Written Opinion for Application No. PCT/EP2022/065819 dated Oct. 10, 2022.
Canadian Intellectual Property Office. Office Action for corresponding application CA 3221455, dated Feb. 11, 2026. 4 pages.
Korean Intellectual Property Office. Notice of Allowance for corresponding application KR 10-2024-7000312, dated Jun. 6, 2026. 10 pages.

* cited by examiner

FRAME FOLDING MECHANISM AND CRIB FRAME

CROSS-REFERENCE TO RELATED APPLICATIONS

This application is a National Stage Application of PCT/EP2022/065819, filed on Jun. 10, 2022 and entitled "FRAME FOLDING MECHANISM AND CRIB FRAME", which claims the benefit of Chinese Application No. 202110648821.6, filed on Jun. 10, 2021 and entitled "FRAME FOLDING MECHANISM AND CRIB FRAME", both of which are incorporated herein by reference in their entirety.

TECHNICAL FIELD

The present disclosure relates to the field of baby cribs, in particular to a frame folding mechanism and a crib frame having the same.

BACKGROUND

A crib is a product for a baby to rest thereon, and facilitates a caregiver to take care of the baby. For the currently available crib having a crib frame with foldable supporting legs, when it is in use and in an unfolded state, the supporting legs tends to shake, and thus the crib may not be sufficiently stable during its use, resulting in a poor use experience.

SUMMARY

An objective of the present application is to provide a frame folding mechanism of a crib frame, which can enable the crib frame to be stable and not easy to shake during use.

Another objective of the present application is to provide a frame folding mechanism of a crib frame with reliable structure and convenient operation.

The present disclosure is intended to provide a frame folding mechanism of a crib frame which can alleviate or eliminate at least one of the above-mentioned defects.

The present disclosure is also intended to provide a crib frame including the above-mentioned frame folding mechanism.

To achieve the above objectives, an aspect of the present application provides a frame folding mechanism for a crib frame. The crib frame includes a frame portion and a supporting portion. The frame folding mechanism includes a transverse rod positioned below the frame portion; a connecting rod having a first end pivotably connected to the supporting portion; and a clamping assembly sleeved on the transverse rod. A second end of the connecting rod opposite to the first end may be pivotably connected to the clamping assembly, and the clamping assembly is manipulated to fix the clamping assembly with the transverse rod or slide the clamping assembly relative to the transverse rod.

In an embodiment, the clamping assembly is fixed with the transverse rod in at least two positions.

In an embodiment, the supporting portion of the crib frame may pivot between an unfolded position and a folded position relative to the frame portion, and the transverse rod is formed with a folding fixing groove and an unfolding fixing groove. When the supporting portion is in the unfolded position, the clamping assembly is fixed to the folding fixing groove, and when the supporting portion is in the folded position, the clamping assembly is fixed to the folding fixing groove.

In an embodiment, the clamping assembly includes a sliding sleeve formed as a casing of the clamping assembly; an unlock button at least partially exposed to the outside of the sliding sleeve and capable of being actuated; an clamping portion displaced in a first direction in response to the unlock button being actuated; and a reset member that applies a force in a second direction opposite to the first direction to the clamping portion, so that the reset member tends to displace the clamping portion in the second direction when the unlock button is not actuated.

In an embodiment, a peripheral size of the clamping portion corresponds to a size of the unfolding fixing groove.

In an embodiment, the clamping portion is in close fit with the unfolding fixing groove.

In an embodiment, the clamping assembly includes an unlock button and a clamping portion, each of the unlock button and the clamping portion are formed on both sides of the transverse rod respectively, and the transverse rod includes a folding fixing groove and an unfolding fixing groove that correspond to the clamping portion.

In an embodiment, the clamping assembly has one or two reset members.

In an embodiment, the first direction is a direction away from the transverse rod, and the second direction is a direction close to the transverse rod.

In an embodiment, the clamping portion is provided with a guiding portion, and the guiding portion may guide the clamping portion into the folding fixing groove and/or the unfolding fixing groove.

In an embodiment, the transverse rod is formed with a recess, the recess is formed at a position corresponding to the folding fixing groove and/or the unfolding fixing groove in a length direction of the transverse rod, and the sliding sleeve is provided with a projection cooperated with the recess; or alternatively, the transverse rod is formed with the projection, the projection is formed at the position corresponding to the folding fixing groove and/or the unfolding fixing groove in the length direction of the transverse rod, and the sliding sleeve is provided with the recess cooperated with the projection.

In an embodiment, in a case that the transverse rod is formed with the recess, an elastic deformable portion is formed on the sliding sleeve, and the projection is disposed on an inner surface of the elastic deformable portion; or alternatively, in a case that the transverse rod is formed with the projection, the elastic deformable portion is formed on the sliding sleeve, and the recess is disposed on the inner surface of the elastic deformable portion.

In an embodiment, the sliding sleeve includes an upper housing and a lower housing that are cooperated with each other, and the upper housing and/or the lower housing are/is provided with the elastic deformable portion.

In an embodiment, the connecting rod includes a first pivot shaft rotatably provided to the clamping assembly; a second pivot shaft rotatably provided to the supporting portion; a first connecting rod portion connecting an end of the first pivot shaft and an end of the second pivot shaft; and a second connecting rod portion connecting the other end of the first pivot shaft and the other end of the second pivot shaft, wherein the first connecting rod portion and the second connecting rod portion are respectively formed on both sides of the transverse rod.

In an embodiment, the first connecting rod portion and the second connecting rod portion are formed in a bent shape and are mirror-symmetrical with each other.

In an embodiment, a bending angle formed by the first connecting rod portion and the second connecting rod portion is greater than 90 degrees.

In an embodiment, levels of both ends of the transverse rod are greater than a level of a middle part of the transverse rod.

Another aspect of the present application provides a crib frame including a frame portion, a supporting portion and the frame folding mechanism as described above.

In an embodiment, the crib frame includes two supporting portions, the frame folding mechanism includes two connecting rods and two clamping assemblies, and each of opposite sides of the transverse rod is formed with a folding fixing groove and an unfolding fixing groove.

The frame folding mechanism of the crib frame provided by the present disclosure ensures that the crib frame has a stable structure and is not easy to shake when in use; the connection between the frame portion and the supporting portion of the crib frame is reliable and tight, and there is no unexpected gap between the frame portion and the supporting portion; meanwhile, the folding operation of the crib frame is simple, convenient, labor-saving and can reduce a possibility of misoperation.

BRIEF DESCRIPTION OF THE DRAWINGS

By considering the following detailed description of the preferred embodiments of the disclosure in conjunction with the accompanying drawings, various objectives, features and advantages of the disclosure will become more apparent. The drawings are merely exemplary illustrations of the disclosure and are not necessarily drawn to scale. In the drawings, the same reference numerals always refer to the same or similar parts, in which.

LIST OF REFERENCE NUMBERS

Crib Frame 1
Frame Portion 10
Supporting Portion 20
Frame Folding Mechanism 30
Connecting Rod 310
First Pivot Shaft 311
Second Pivot Shaft 312
First Connecting Rod Portion 313
Second Connecting Rod Portion 314
Transverse Rod 320
Folding Fixing Groove 321
Unfolding Fixing Groove 322
Upper Recess 323
Lower Recess 324
Clamping Assembly 330
Sliding Sleeve 331
Upper Housing 3311
Lower Housing 3312
Unlock Button 332
Clamping Portion 333
Receiving Groove 3331
Guiding Portion 3332
Reset Member 334, 334'
Lever Member 335
Elastic Deformable Portion 336
Upper Projection 337
Lower Projection 338

DETAILED DESCRIPTION

In order to further explain the principle and structure of the disclosure, the preferred embodiments of the disclosure will be described in detail with reference to the accompanying drawings. However, these embodiments are only for illustrative and explanatory purposes, and cannot be used to limit the patent protection scope of the disclosure.

The terms used in the disclosure are only for the purpose of describing specific embodiments, and are not intended to limit the disclosure. The singular forms of "a", "said" and "the" used in the disclosure and the appended claims are also intended to include plural forms, unless the context clearly indicates other meanings. It should also be understood, the terms "and/or" as used herein refers to and includes any or all possible combinations of one or more associated listed items. Directional terms such as "first direction" and "second direction" used in the present application do not have limiting meanings, but are used for distinguishing.

It is necessary to provide a frame of a crib that is lockable, stable and not easy to shake.

Figure 1:
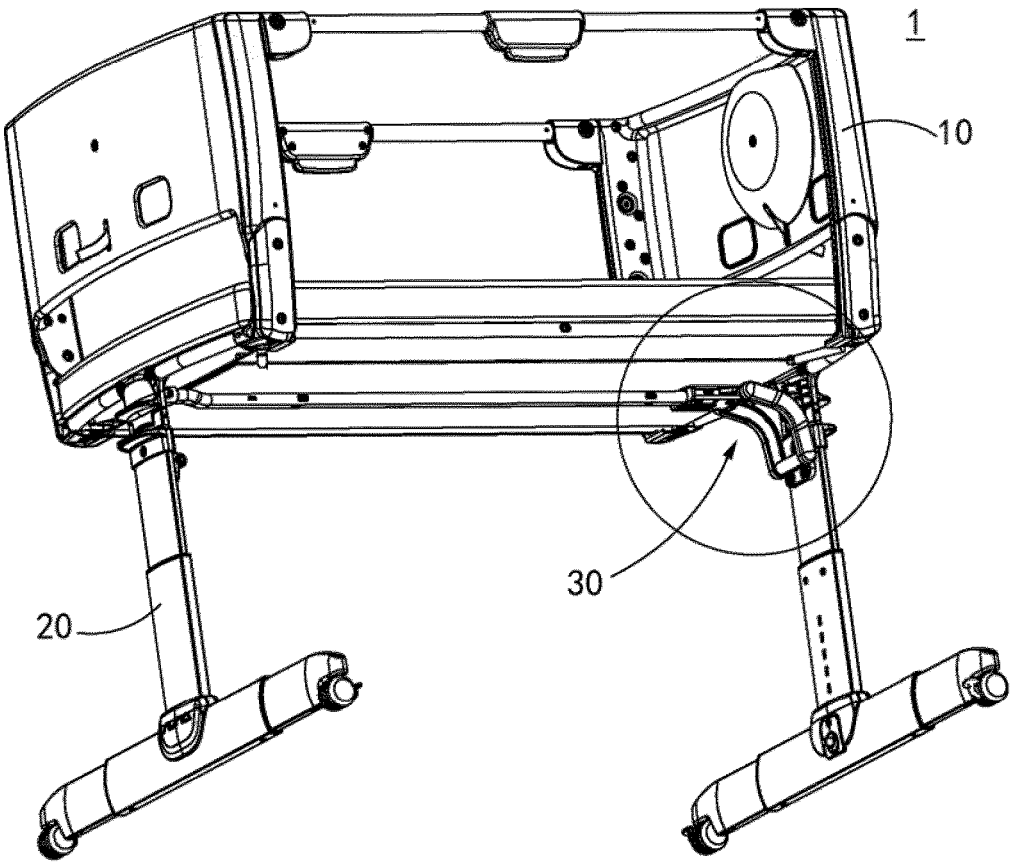
FIG. 1 is a perspective view of a crib frame of the present application.
Figure 2:
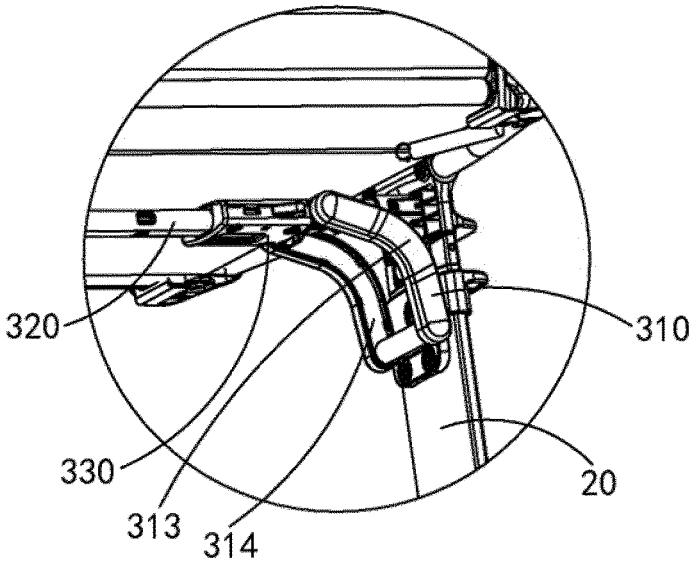
FIG. 2 is a partial enlarged view of FIG. 1.
Figure 3:
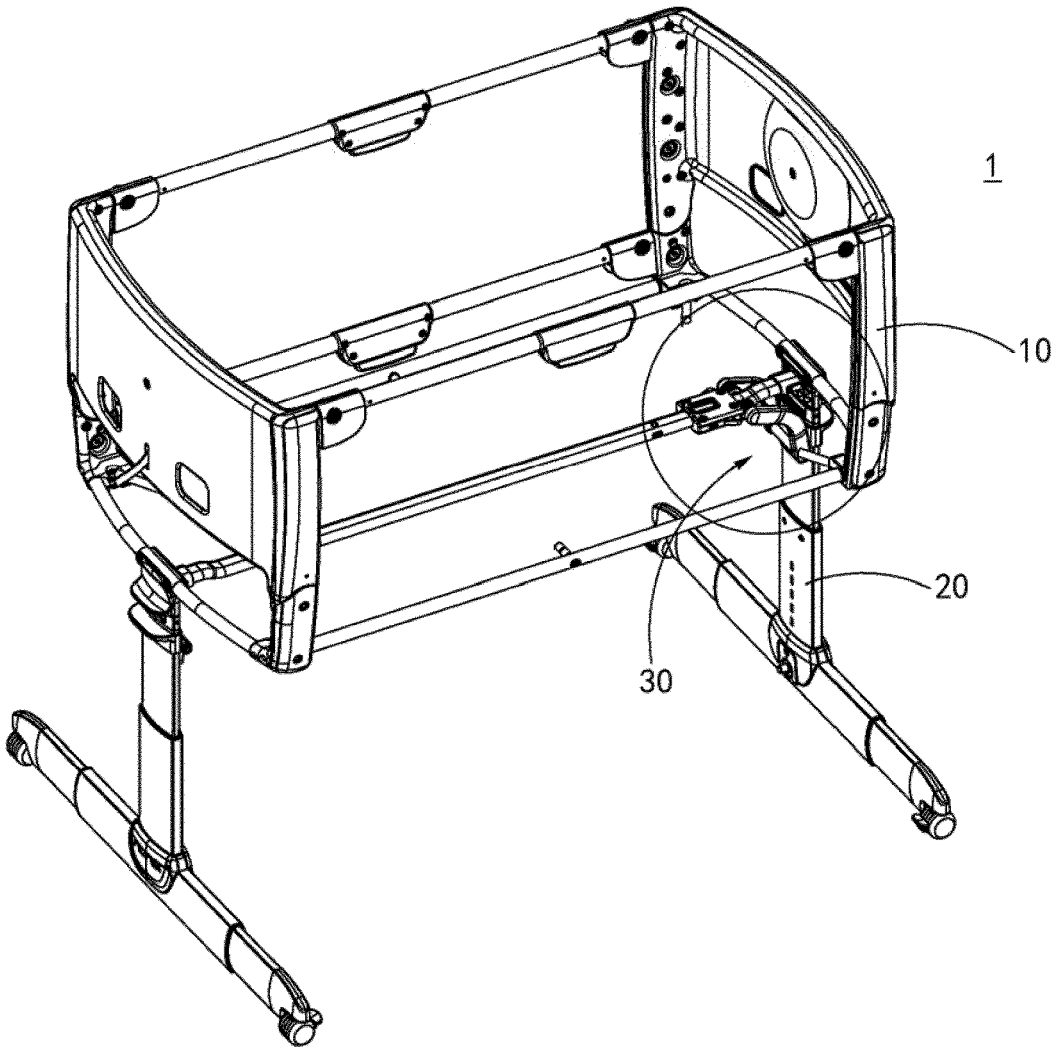
FIG. 3 is another perspective view of the crib frame of the present application.
Figure 5:
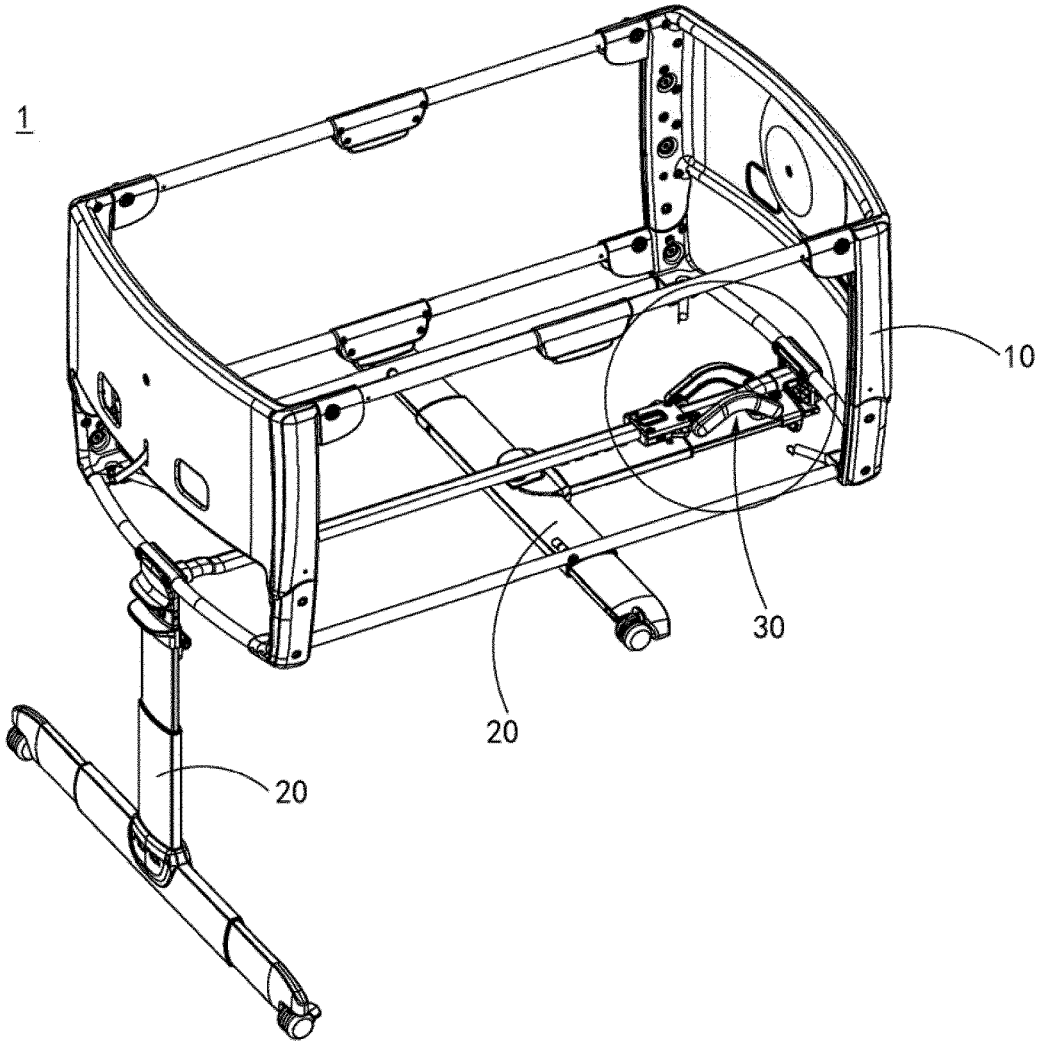
FIG. 5 is a perspective view of a supporting portion of the crib frame of the present application in a folded position.

Referring to FIGS. 1, 2 and 5, a crib frame 1 of the present application is foldable, and when it is in use, a baby or child may sleep or play on it. The crib frame 1 may include a frame portion 10 and a supporting portion 20. The crib frame 10 may be used to provide an activity space for babies or children. There may be two supporting portions 20, which may be disposed below both ends of the frame portion 10 in a longitudinal direction. The number of the supporting portion 20 is not limited in the present application. The supporting portion 20 may pivot between an unfolded position (as shown in FIG. 1) and a folded position relative to folded position relative to the frame portion 10. The folded position may be a position where all the supporting portions 20 pivot to a substantial horizontal direction. In the folded position, the crib frame 1 may have a small volume, facilitating storage and transportation.

A frame folding mechanism 30 of the crib frame 1 may be connected to the frame portion 10 and the supporting portion 20, respectively, so as to operate the supporting portion 20 to be easily folded, and stably hold the supporting portion 20 in the unfolded position or the folded position.

The frame folding mechanism 30 may include a transverse rod 320 positioned below the frame portion 10; a connecting rod 310 having a right end (without limitation, see FIG. 2) pivotally connected to the supporting portion 20; and a clamping assembly 330 sleeved on the transverse rod 320. A left end (without limitation) of the connecting rod 310 is pivotally connected to the clamping assembly 330. The clamping assembly 330 may be manipulated to fix the clamping assembly 330 with the transverse rod 320 or to slide clamping assembly 330 relative to the transverse rod 320.

The transverse rod 320 may be centrally disposed below a lower surface of the frame portion 10 in the longitudinal direction of the frame portion 10 (i.e., a left-right direction in FIG. 1). The transverse rod 320 may have a hollow structure. Both ends of the transverse rod 320 may be engaged with the frame portion 10 or engaged with a position where the frame portion 10 is connected with the supporting portion 20. Optionally, both ends of the transverse rod 320 may be fixed to the frame portion 10 or the position where the frame portion 10 is connected with the supporting portion 20. During pivoting of the supporting portion 20, the transverse rod 320 may remain stationary.

Figure 8:
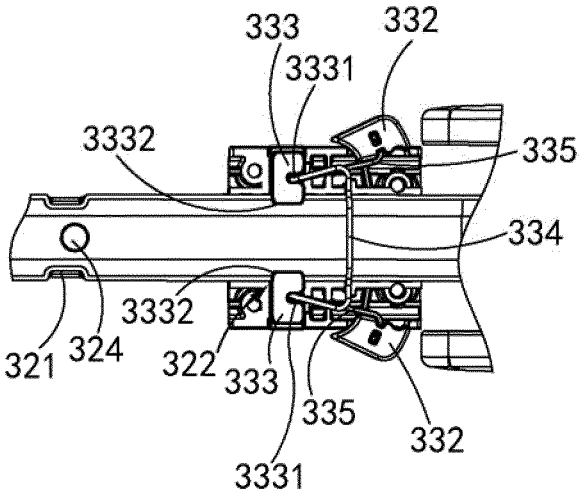
FIG. 8 is another schematic partial sectional perspective view of the frame folding mechanism of the present application.
Figure 9:
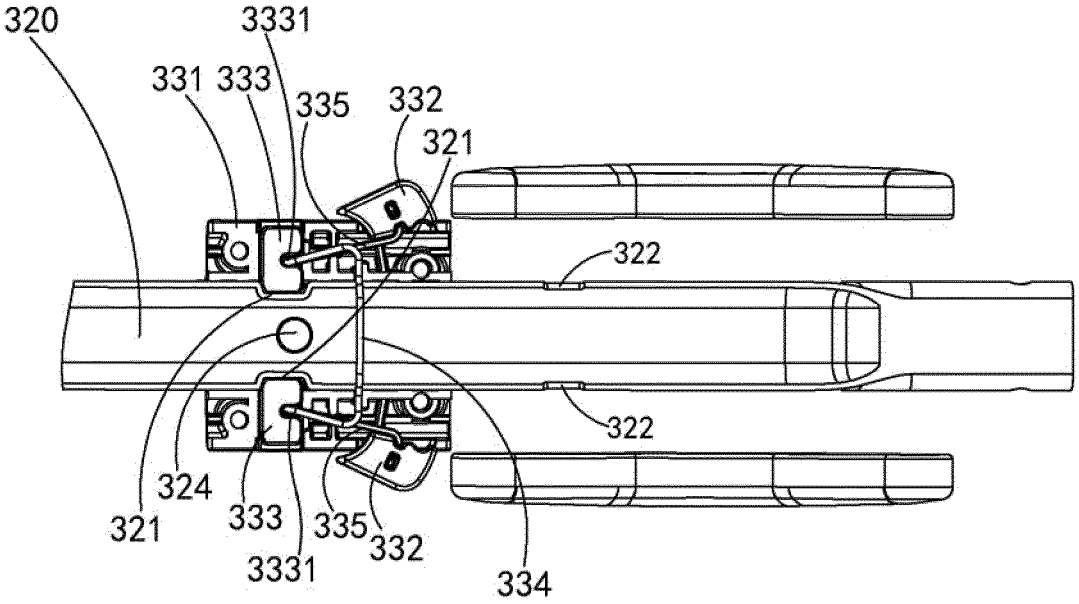
FIG. 9 is yet another schematic partial sectional perspective view of the frame folding mechanism of the present application.
Figure 10:
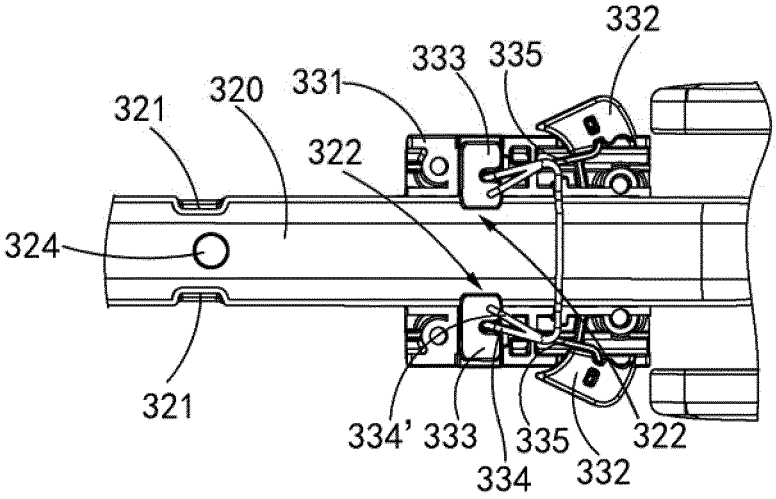
FIG. 10 is still another schematic partial sectional perspective view of the frame folding mechanism of the present application.
Figure 11:
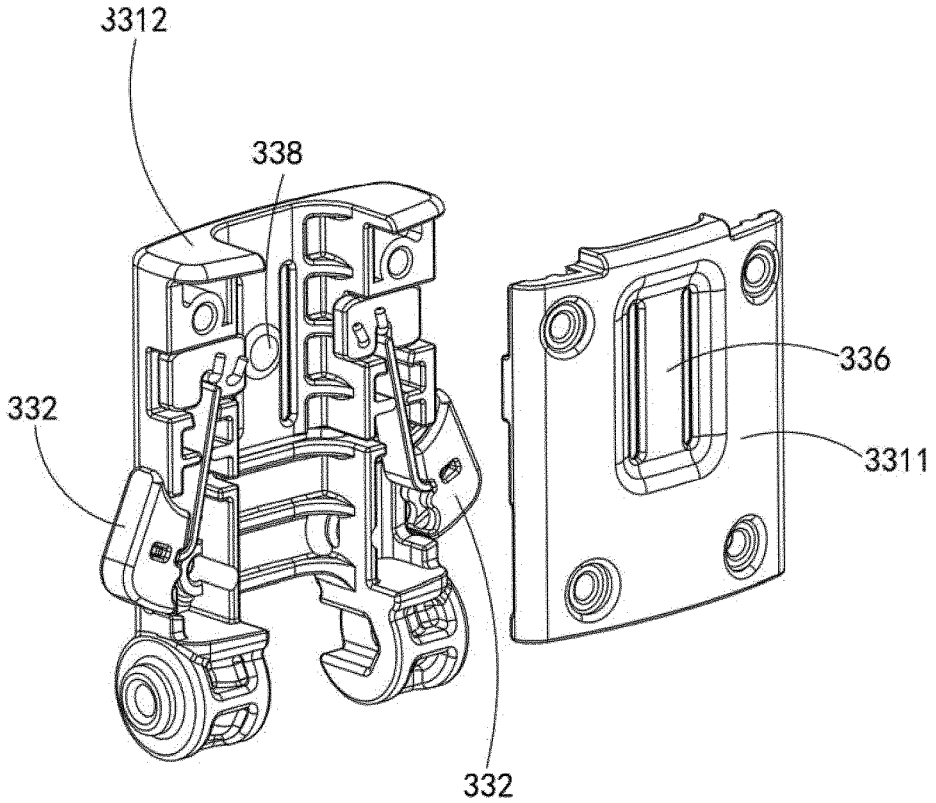
FIG. 11 is an exploded perspective view of an embodiment of a clamping assembly of the frame folding mechanism of the present application.
Figure 12:
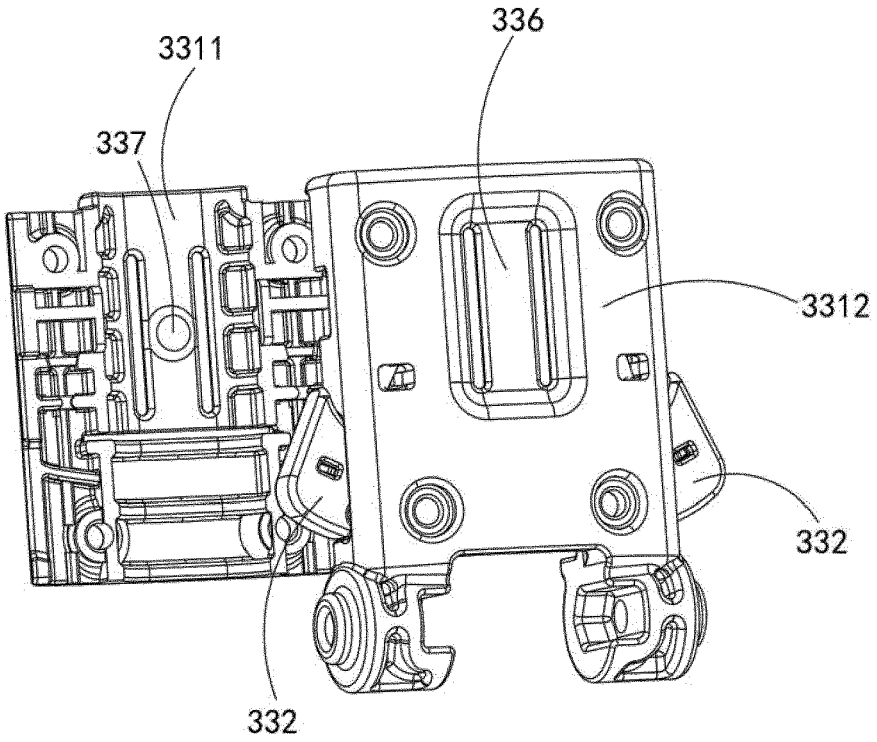
FIG. 12 is an exploded perspective view from another perspective of an embodiment of the clamping assembly of the frame folding mechanism of the present application.
Figure 13:
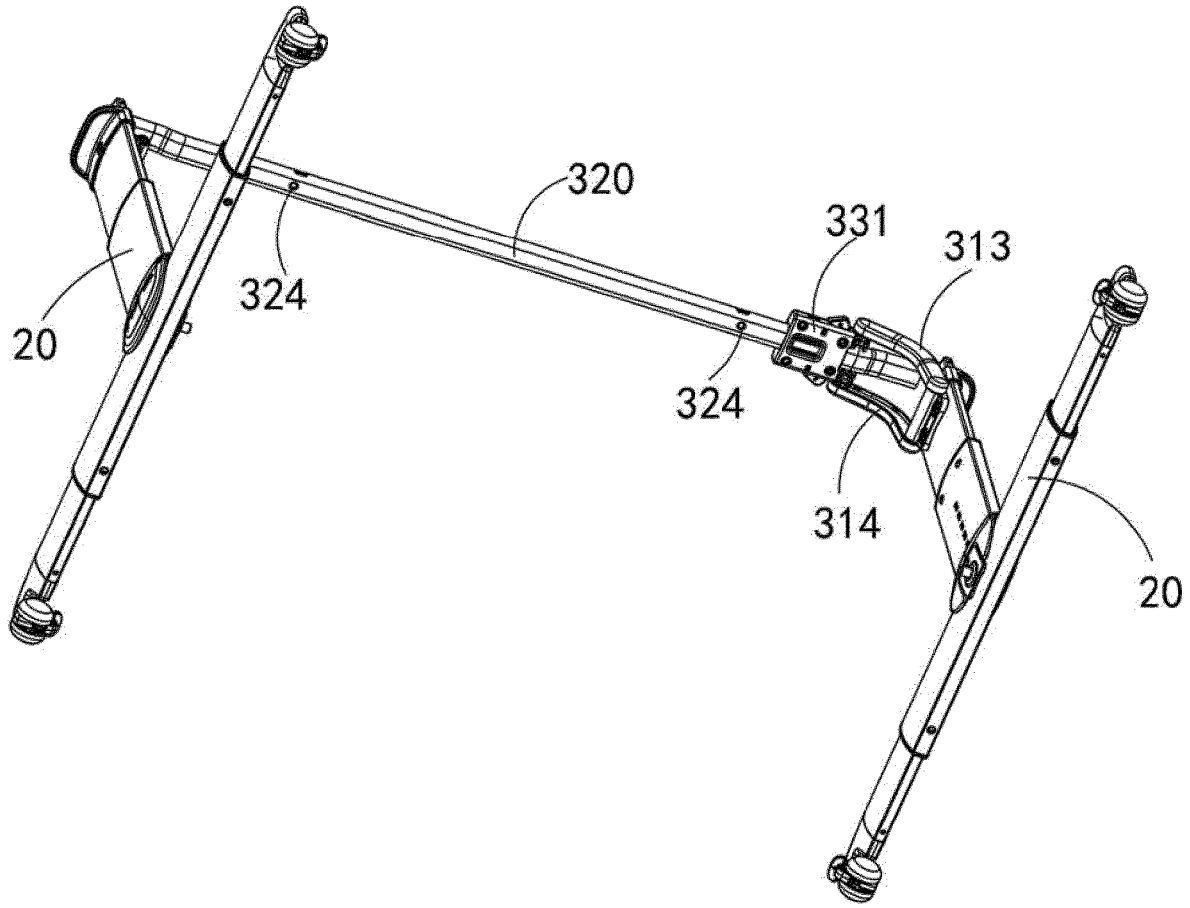
FIG. 13 is a bottom perspective view of some elements of another embodiment of the frame folding mechanism of the present application.
Figure 14:
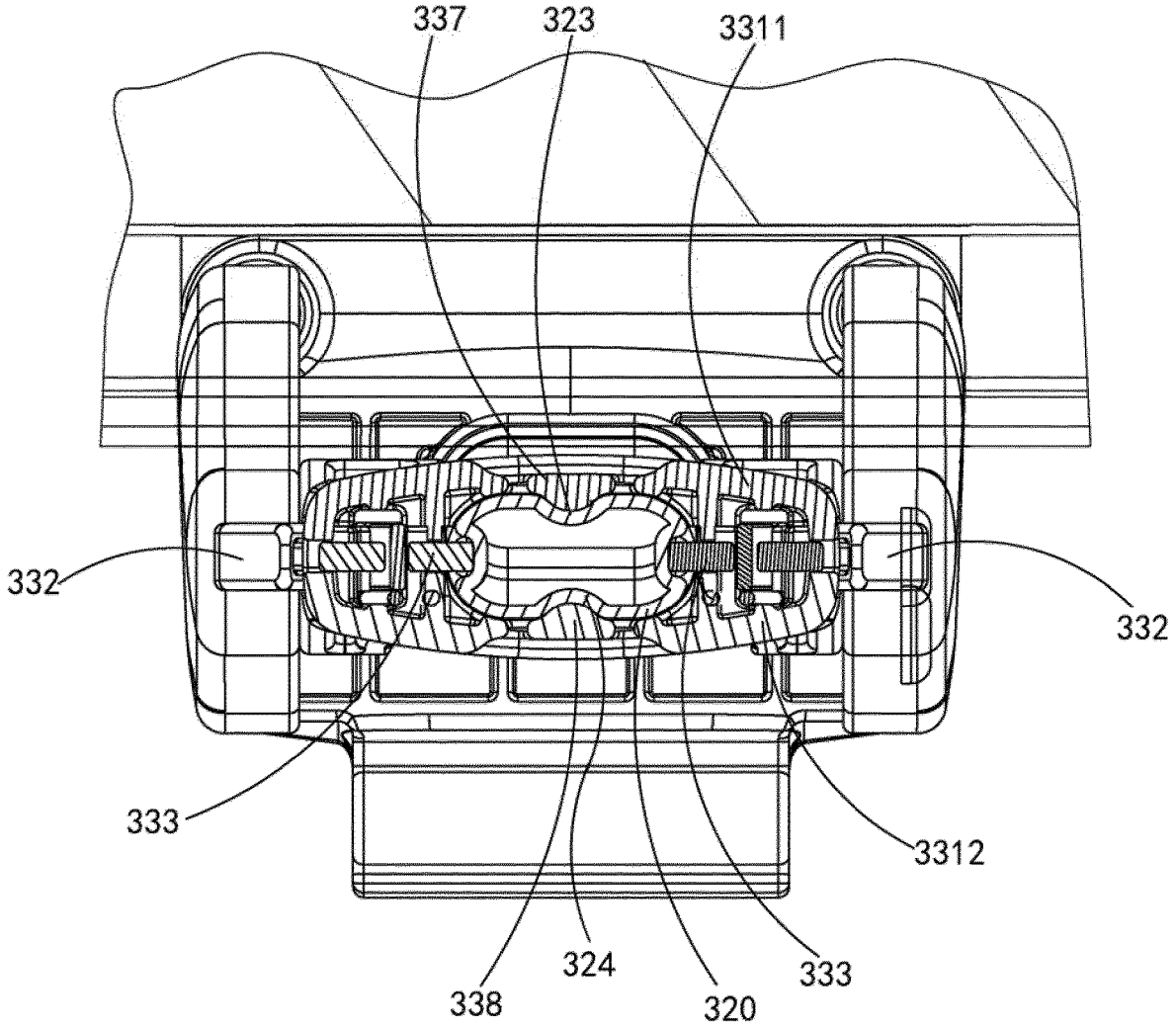
FIG. 14 is a sectional view of some elements of another embodiment of the frame folding mechanism of the present application.

The transverse rod 320 may be formed with a folding fixing groove 321 and an unfolding fixing groove 322 (as shown in FIGS. 8 and 9). When the supporting portion 20 is in the unfolded position, the clamping assembly 330 may be fixed to the unfolding fixing groove 322, so that the frame portion 10 can be stably supported without shaking, and when the supporting portion 20 is in the folded position, the clamping assembly 330 may be fixed to the folding fixing groove 321, so that the supporting portion 20 can be kept in the folded position without being undesirably unfolded.

Optionally, the transverse rod 320 may also be provided with any fixing groove other than the folding fixing groove 321 and the unfolding fixing groove 322, so that the supporting portion 20 can be kept at a desired angle or position as required.

In this embodiment, each side of the transverse rod 320 has a folding fixing groove 321 and an unfolding fixing groove 322. The number of the folding fixing groove 321 and the unfolding fixing groove 322 is not limited in the present application. Correspondingly, in this embodiment, the frame folding mechanism 30 may have two connecting rods 310 and two clamping assemblies 330. The number of connecting rod 310 and clamping assembly 330 is not limited in the present application. Optionally, the transverse rod 320 may have another number of folding fixing groove 321 and unfolding fixing groove 322, and the frame folding mechanism 30 may have another number of connecting rod 310. Optionally, the number of the folding fixing groove 321 and the unfolding fixing groove 322 corresponds to the number of the connecting rod 310 and the number of the clamping assembly 330. In this embodiment, the frame folding mechanism 30 has one transverse rod 320. Optionally, the frame folding mechanism 30 may have another number of transverse rod 320, which may be arranged parallel to each other or at an angle.

As shown in FIGS. 2, 4, and 6-8, the clamping assembly 330 may include a sliding sleeve 331 formed as a casing of the clamping assembly 330; a unlock button 332 at least partially exposed to the outside of the sliding sleeve 331 and capable of being actuated; a clamping portion 333 displaced (or moved by a certain distance) in a direction away from the transverse rod 320 (i.e., a first direction) in response to the unlock button 332 being actuated; a reset member 334 constantly applies a force towards the transverse rod 320 to the clamping portion 333, so that the reset member 334 tends to displace the clamping portion 333 in a direction towards the transverse rod 320 (i.e., a second direction) when the unlock button 332 is not actuated.

The sliding sleeve 331 may be formed into a relatively flat and approximately hexahedral shape, which is convenient to be held and operated by hand. There may be two unlock buttons 332, which are respectively disposed on both sides of the sliding sleeve 331, and are convenient to be actuated by fingers (such as a thumb and a forefinger) pressing inward (toward the transverse rod 320). The two unlock buttons 332 can achieve more stable fixation, and may be symmetrically arranged. The number of unlock button 332 is not limited in the present application, that is, there may be another number of unlock button 332.

As shown in FIGS. 7-10, a side of the clamping portion 333 may have a receiving groove 3331. A lever member 335 may be disposed between the unlock button 332 and the receiving groove 3331, so that when the reset member 334 is pressed inward (as shown by an arrow in FIG. 7), the lever member 335 pushes the clamping portion 333 outwardly through the receiving groove 3331.

The reset member 334 may be formed as an elastic element as shown in FIGS. 7-10. The reference number of 334' in FIG. 10 indicates a shape of the reset member 334 in a natural state. Therefore, when the reset member 334 is disposed in the receiving grooves 3331 in the two clamping portions 333, the reset member 334 is in an elastically deformed state, so that a constant inward force may be applied to the two clamping portions 333. The number of clamping portion 333 is not limited in the present application, that is, there may be another number of clamping portion 333.

In other embodiments, the reset member 334 may be formed as a spring disposed between the clamping portion 333 and an inner wall of the sliding sleeve 331. The reset member 334 may also be formed in another form as long as it can apply an inward pushing force on the clamping portion 333.

In other embodiments, the clamping assembly 330 may only have one unlock button 332 and one clamping portion 333. One, two or more reset members 334 may be provided as required.

A peripheral size of the clamping portion 333 may correspond to sizes of the folding fixing groove 321 and the unfolding fixing groove 322, so that the clamping portion 333 may exactly extend into and be held in the folding fixing groove 321 or the unfolding fixing groove 322. When the clamping portion 333 extends into the folding fixing groove 321 or the unfolding fixing groove 322, a gap between the clamping portion 333 and the folding fixing groove 321 or the unfolding fixing groove 322 is as small as possible, or the clamping portion 333 and the folding fixing groove 321 or the unfolding fixing groove 322 form a tight fit. Due to an elastic restoring force of the reset member 334, the sliding sleeve 331 will not slide easily, so that the crib frame 1 is more stable without shaking after being unfolded. More specifically, the unfolding fixing groove 322 is a through hole, and the clamping portion 333 is directly clamped into the through hole, which increases a cooperation area between the clamping portion 333 and the unfolding fixing groove 322, so that the sliding sleeve 331 and the transverse rod 320 may be fixed and limited more reliably, that is, the frame portion 10 and the supporting portion 20 will not shake relatively, so as to ensure the overall stability of the crib frame 1 after unfolding. Especially, under the action of the reset member 334, the clamping portion 333 is clamped into the through hole more deeply, the cooperation area is larger, the stability of the crib frame after unfolding is better, and the possibility of shaking of the crib frame is further reduced. Since a large locking force is not required when folded, the folding fixing groove 321 may be provided as a sinking groove, which ensures a better limitation and fixation to be formed between the clamping portion 333 and the folding fixing groove 321, so as to prevent the support portion 20 from falling after being folded, and at the same time, facilitates disengagement of the clamping portion 333 from the folding fixing groove 321, so as to facilitate unfolding of the supporting portion 20, that is, the unfolding and use of the crib frame 1.

The clamping portion 333 may be provided with a guiding portion 3332. The guiding portion 3332 may be a chamfer or a tapered surface or the like. The guiding portion 3332 may guide the clamping portion 333 into the folding fixing groove 321 and/or the unfolding fixing groove 322. With the help of the pushing force provided by the guiding portion 3332 and the reset member 334, the clamping portion 333 may automatically enter the folding fixing groove 321 or the unfolding fixing groove 322, or at least reduce a force required to further move the clamping assembly 330, when its guiding portion 332 contacts the folding fixing groove 321 or the unfolding fixing groove 322.

Figure 4:
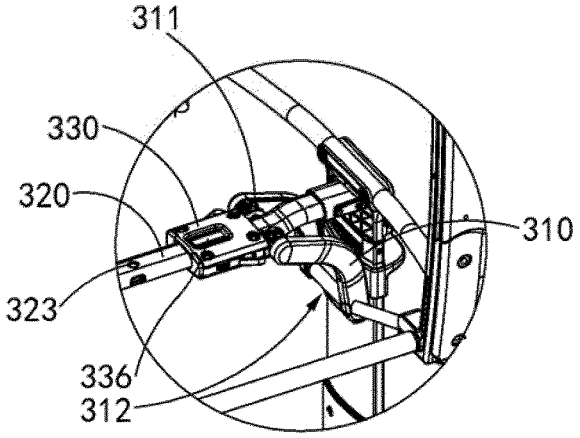
FIG. 4 is a partial enlarged view of FIG. 3.

Referring to FIGS. 2 and 4, an end of the connecting rod 310 is pivotally connected to the supporting portion 20, and another end of the connecting rod 310 is pivotally connected to the clamping assembly 330. The connecting rod 310 may include a first pivot shaft 311 rotatably provided to the clamping assembly 330; a second pivot shaft 312 rotatably provided to the supporting portion 20; a first connecting rod portion 313 connecting an end of the first pivot shaft 311 and an end of the second pivot shaft 312; and a second connecting rod portion 314 connecting the other end of the first pivot shaft 311 and the other end of the second pivot shaft 312. The first connecting rod portion 313 and the second connecting rod portion 314 may be formed at both sides of the transverse rod 320, respectively.

Optionally, the connecting rod 310 may only have the first connecting rod portion 313 or the second connecting rod portion 314.

The first connecting rod portion 313 and the second connecting rod portion 314 may be formed in a bent shape and mirror-symmetrical with each other. Optionally, the first connecting rod portion 313 and the second connecting rod portion 314 may be asymmetrical with each other. The bent shape may make the connecting rod 310 occupy less space under the frame portion 10, and at the same time, it may keep the supporting portion 20 stable relative to the frame portion 10.

A bending angle formed by the first connecting rod portion 313 and the second connecting rod portion 314 may be greater than 90 degrees. The bending angle formed by the first connecting rod portion 313 and the second connecting rod portion 314 may be less than 180 degrees. A bending portion formed by the first connecting rod portion 313 and the second connecting rod portion 314 may be a gentle transition.

Figure 6:
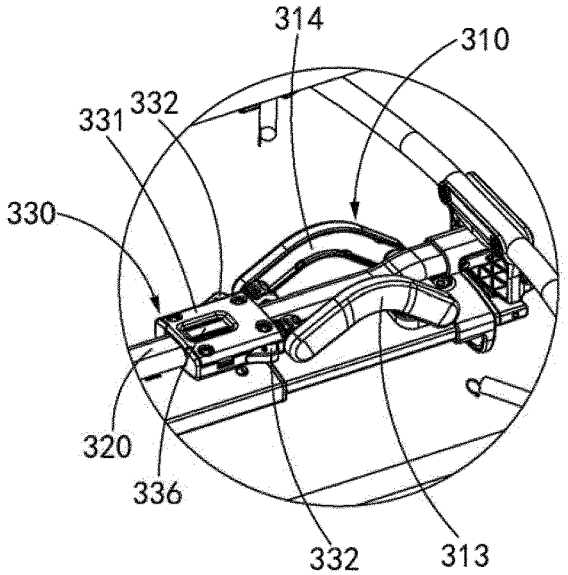
FIG. 6 is a partial enlarged view of FIG. 5.
Figure 7:
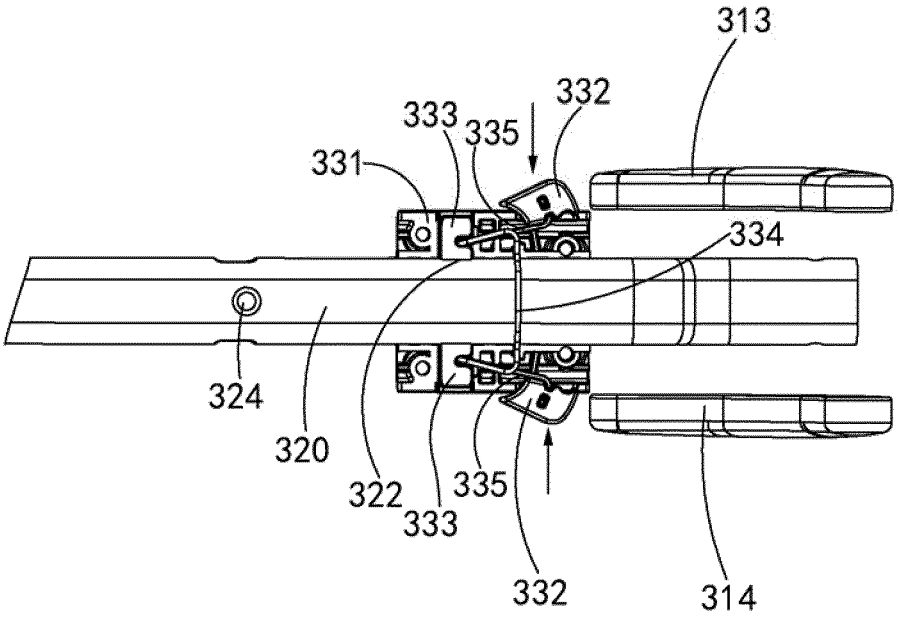
FIG. 7 is a schematic partial sectional perspective view of the frame folding mechanism of the present application.

Referring to FIG. 6, when the supporting portion 20 is folded, the first connecting rod portion 313 and the second connecting rod portion 314 may be partially located above the transverse rod 320.

Referring to FIGS. 8-14, the transverse rod 320 may be formed with recesses, such as an upper recess 323 (see FIG. 14) and a lower recess 324. In the longitudinal direction of the transverse rod 320, the upper recess 323 and the lower recess 324 are formed at position(s) corresponding to the folding fixing groove 321 and/or the unfolding fixing groove 322. Specifically, the upper recess 323 and the lower recess 324 may be formed as spherical recesses, and a center point of the upper recess 323 or the lower recess 324 may be biased to a side of the folding fixing groove 321 or the unfolding fixing groove 322. Accordingly, the sliding sleeve 331 may be formed with an elastic deformation portion 336. The sliding sleeve 331 may be provided with an upper projection 337 and a lower projection 338 (see FIG. 14) which cooperate with the upper recess 323 and the lower recess 324. The upper projection 337 and the lower projection 338 may be provided on an inner surface of the elastic deformation portion 336 facing the transverse rod 320. When the clamping assembly 330 passes through the upper recess 323 and the lower recess 324, the upper projection 337 and the lower projection 338 on the elastic deformation portion 336 may move into the upper recess 323 and the lower recess 324 due to the elasticity of the elastic deformation portion 336, so that a certain resistance is generated when the clamping assembly 330 is further moved, thereby prompting the operator that the folding fixing groove 321 or unfold the fixing groove 322 is approaching. When the upper projection 337 and the lower projection 338 of the elastic deformation portion 336 completely enter the upper recess 323 and the lower recess 324, the clamping portion 333 is exactly aligned with the folding fixing groove 321 or the unfolding fixing groove 322. The transverse rod 320 may have only one of the upper recess 323 and the lower recess 324. Accordingly, the sliding sleeve 331 may be provided with only one of the upper projection 337 and the lower projection 338. One, two or more upper recess 323 or the lower recess 324 may be provided, respectively, so as to optionally correspond to the folding fixing groove 321, the unfolding fixing groove 322 or another fixing groove. The upper recess 323 or the lower recess 324 may be formed in a circular shape, an elongated shape, a square shape, or the like.

In another embodiment (not shown), the upper recess 323 and the lower recess 324 may be formed on the elastic deformation portion 336, and the upper projection 337 and the lower projection 338 may be formed on the transverse rod 320. That is, the upper recess 323 and the lower recess 324, and the upper projection 337 and the lower projection 338 in this embodiment are just interchanged with each other with respect to those in the previous embodiment.

It should be understood that the recesses 323, 324 and projections 337, 338 on the transverse rod 320 and the elastic deformable portion 336 may prompt positions of the folding fixing groove 321, the unfolding fixing groove 322 or another fixing groove, so that an operator may still conveniently determine the positions of the folding fixing groove 321, the unfolding fixing groove 322 or another fixing groove even if these positions cannot be directly observed by the operator. The positions of the projections 337 and 338 and the recesses 323 and 324 may be interchanged with each other.

Referring to FIGS. 11 to 14, the sliding sleeve 331 may include an upper housing 3311 and a lower housing 3312 which are cooperated with each other. The upper housing 3311 and/or the lower housing 3312 may be provided with an elastic deformable portion 336. The elastic part 336 may be provided on the upper housing 3311 and/or the lower housing 3312. That is, the protrusions 337, 338, which are cooperated with the recesses 323, 324 on the transverse rod 320, may be provided on the elastic deformation portions 336 of the upper and lower housings 3311, 3312. When the projections 337, 338 are provided on the upper housing 3311 and the lower housing 3312, the transverse rod 320 may be provided with recesses 323, 324 on an upper side and a lower side correspondingly. In another embodiment (not shown), when the recesses 323 and 324 are provided on the upper housing 3311 and the lower housing 3312, the transverse rod 320 may be provided with projections 337 and 338 on the upper side and the lower side correspondingly.

Referring to FIG. 6, levels of both ends of the transverse rod 320 may be greater than a level of a middle part of the transverse rod 320. In this way, when the supporting portion 20 is folded, the first connecting rod portion 313 and a part of the supporting portion 20 that receives the first connecting rod portion 313 will not interfere with the transverse rod 320, so that the supporting portion 20 can be folded to a substantially horizontal position.

Other embodiments of the disclosure will be apparent to those skilled in the art from consideration of the specification and practice of the disclosure disclosed herein. This application is intended to cover any variations, uses, or adaptations of the disclosure following, in general, the principles of the disclosure and including such departures from the present disclosure as come within known or customary practice in the art to which the disclosure pertains. It is intended that the specification and examples be considered as exemplary only, with a true scope and spirit of the disclosure being indicated by the following claims.

Although the disclosure has been provided by with reference to typical embodiments, the terms used are illustrative and exemplary rather than restrictive. Since the disclosure can be implemented in various forms without departing from the spirit and essence of the disclosure, it should be understood, the above-mentioned embodiments are not limited to any of the foregoing details, but shall be interpreted in the broadest sense within the scope defined by the claims. Therefore, any variation falling within the scope of the claims or their equivalents shall be covered by the claims.

What is claimed is:

1. A frame folding mechanism for a crib frame, the crib frame comprising a frame portion and a supporting portion, wherein the frame folding mechanism comprises:

a transverse rod positioned below the frame portion;

a connecting rod having a first end pivotably connected to the supporting portion; and a clamping assembly sleeved on the transverse rod, wherein a second end of the connecting rod opposite to the first end is pivotably connected to the clamping assembly, and the clamping assembly is arranged and configured to be fixed with the transverse rod or to slide relative to the transverse rod, and wherein an upper end of the supporting portion is pivotally connected to the frame portion.

2. The frame folding mechanism according to claim 1, wherein the clamping assembly is fixed with the transverse rod in at least two positions.

3. The frame folding mechanism according to claim 1, wherein the supporting portion of the crib frame is pivotable between an unfolded position and a folded position relative to the frame portion, the transverse rod is formed with a folding fixing groove and an unfolding fixing groove, and when the supporting portion is in the unfolded position, the clamping assembly is fixed to the unfolding fixing groove, and when the supporting portion is in the folded position, the clamping assembly is fixed to the folding fixing groove.

4. The frame folding mechanism according to claim 3, wherein the clamping assembly comprises:

a sliding sleeve formed as a casing of the clamping assembly;

an unlock button at least partially exposed to outside of the sliding sleeve and capable of being actuated;

a clamping portion displaced in a first direction in response to the unlock button being actuated;

a reset member configured to apply a force in a second direction opposite to the first direction to the clamping portion, so that the reset member tends to displace the clamping portion in the second direction when the unlock button is not actuated.

5. The frame folding mechanism according to claim 4, wherein a peripheral size of the clamping portion corresponds to a size of the unfolding fixing groove.

6. The frame folding mechanism according to claim 5, wherein the clamping portion is configured to extend into the unfolding fixing groove.

7. The frame folding mechanism according to claim 4, wherein the clamping assembly comprises an unlock button and a clamping portion, each of the unlock button and the clamping portion are formed on both sides of the transverse rod respectively, and the transverse rod comprises a folding fixing groove and an unfolding fixing groove that correspond to the clamping portion.

8. The frame folding mechanism according to claim 7, wherein the clamping assembly has one or two reset members.

9. The frame folding mechanism according to claim 4, wherein the first direction is a direction away from the transverse rod, and the second direction is a direction close to the transverse rod.

10. The frame folding mechanism according to claim 4, wherein the clamping portion is provided with a guiding portion for guiding the clamping portion into the folding fixing groove and/or the unfolding fixing groove.

11. The frame folding mechanism according to claim 4, wherein the transverse rod is formed with a recess formed at a position corresponding to the folding fixing groove and/or the unfolding fixing groove in a length direction of the transverse rod, and the sliding sleeve is provided with a projection cooperated with the recess; or, the transverse rod is formed with the projection formed at the position corresponding to the folding fixing groove and/or the unfolding fixing groove in the length direction of the transverse rod, and the sliding sleeve is provided with the recess cooperated with the projection.

12. The frame folding mechanism according to claim 11, wherein in a case that the transverse rod is formed with the recess, an elastic deformable portion is formed on the sliding sleeve, and the projection is disposed on an inner surface of the elastic deformable portion; or, in a case that the transverse rod is formed with the projection, the elastic deformable portion is formed on the sliding sleeve, and the recess is disposed on the inner surface of the elastic deformable portion.

13. The frame folding mechanism according to claim 12, wherein the sliding sleeve comprises an upper housing and a lower housing that are cooperated with each other, and the upper housing and/or the lower housing are/is provided with the elastic deformable portion.

14. The frame folding mechanism according to claim 1, wherein the connecting rod comprises:

a first pivot shaft rotatably provided to the clamping assembly;

a second pivot shaft rotatably provided to the supporting portion;

a first connecting rod portion connecting an end of the first pivot shaft and an end of the second pivot shaft; and a second connecting rod portion connecting the other end of the first pivot shaft and the other end of the second pivot shaft, wherein the first connecting rod portion and the second connecting rod portion are respectively formed on both sides of the transverse rod.

15. The frame folding mechanism according to claim 14, wherein the first connecting rod portion and the second connecting rod portion are formed in a bent shape and are mirror-symmetrical with each other.

16. The frame folding mechanism according to claim 15, wherein a bending angle formed by the first connecting rod portion and the second connecting rod portion is greater than 90 degrees.

17. The frame folding mechanism according to claim 1, wherein levels of both ends of the transverse rod is greater than a level of a middle part of the transverse rod.

18. A crib frame, wherein the crib frame comprises a frame portion, a supporting portion and the frame folding mechanism according to claim 1.

19. The crib frame according to claim 18, wherein the crib frame comprises two supporting portions, the frame folding mechanism comprises two connecting rods and two clamping assemblies, and each of opposite sides of the transverse rod is formed with a folding fixing groove and an unfolding fixing groove.

20. A frame folding mechanism for a crib frame, the crib frame comprising a frame portion and a supporting portion, wherein the frame folding mechanism comprises:

a transverse rod positioned below the frame portion;

a connecting rod having a first end pivotably connected to the supporting portion; and a clamping assembly sleeved on the transverse rod, the clamping assembly comprising:

a sliding sleeve formed as a casing of the clamping assembly;

an unlock button at least partially exposed to outside of the sliding sleeve and capable of being actuated;

a clamping portion displaced in a first direction in response to the unlock button being actuated;

a reset member configured to apply a force in a second direction opposite to the first direction to the clamping portion, so that the reset member tends to displace the clamping portion in the second direction when the unlock button is not actuated, wherein a second end of the connecting rod opposite to the first end is pivotably connected to the clamping assembly, and the clamping assembly is arranged and configured to be fixed with the transverse rod or to slide relative to the transverse rod.

* * * * *